US005255459A

United States Patent [19]

Verret

[11] Patent Number: 5,255,459

[45] Date of Patent: Oct. 26, 1993

[54] FRAMING SYSTEM FOR SIGNS

[76] Inventor: Normand Verret, 68 P'tiso Park, Edmundston, N. B., Canada, E3V 3X7

[21] Appl. No.: 805,680

[22] Filed: Dec. 12, 1991

[51] Int. Cl.[5] ..... G09F 17/00

[52] U.S. Cl. ..... 40/603; 40/563; 40/574

[58] Field of Search ..... 40/603, 549, 563, 574; 160/378, 402, 404, 380

[56] References Cited

U.S. PATENT DOCUMENTS

| | | | |
|---|---|---|---|
| 2,915,844 | 12/1959 | Thomas | 40/563 |
| 4,547,987 | 10/1985 | Stilling | 40/603 X |
| 4,937,961 | 7/1990 | Gandy et al. | 40/574 X |
| 4,955,928 | 9/1990 | Tanner | 40/603 |

*Primary Examiner*—Laurie K. Cranmer

[57] ABSTRACT

The new framing system for signs provides a method of stretching the flexible sign material across the opening of a frame. The tensional devices are installed manually from the outside of the sign at regular spacings on the edges of the flexible sign material. The tensional devices are installed by closing the device on, and by the same movement, puncturing retaining holes on the edges of the flexible sign material. The adjustment of the tension of the flexible sign material is done by pushing inwardly on each tensional device to engage it onto a series of serrations inside a slot facing outwardly along the edges of the frame. The outside edges of the frame are held rigid with frame members extending from the bottom of the sign, and thus eliminating the need for support members, between the flexible sign material and the lamps, which normally transmit shadows to the face of the sign. The new framing system can be re-opened for maintenance purposes using a slot type blade screwdriver to pry the tensional devices out of the serrations. The tensional devices and the slot on the periphery of the sign are covered by a cap which locks in place on mating lips, and which can be removed manually by twisting it inwardly along its length.

3 Claims, 16 Drawing Sheets

FRAMING SYSTEM FOR SIGNS

Figure 1:
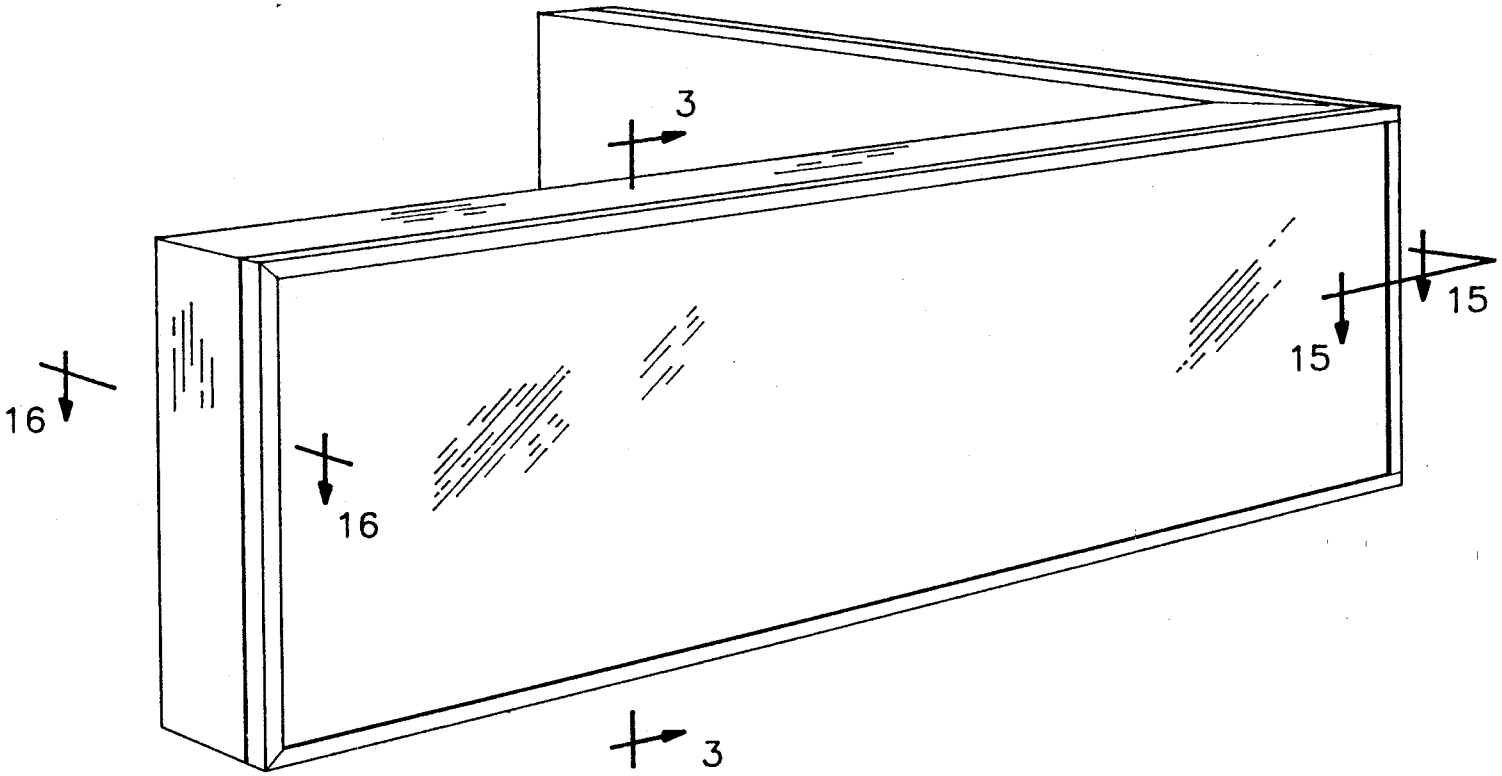
Figure 2:
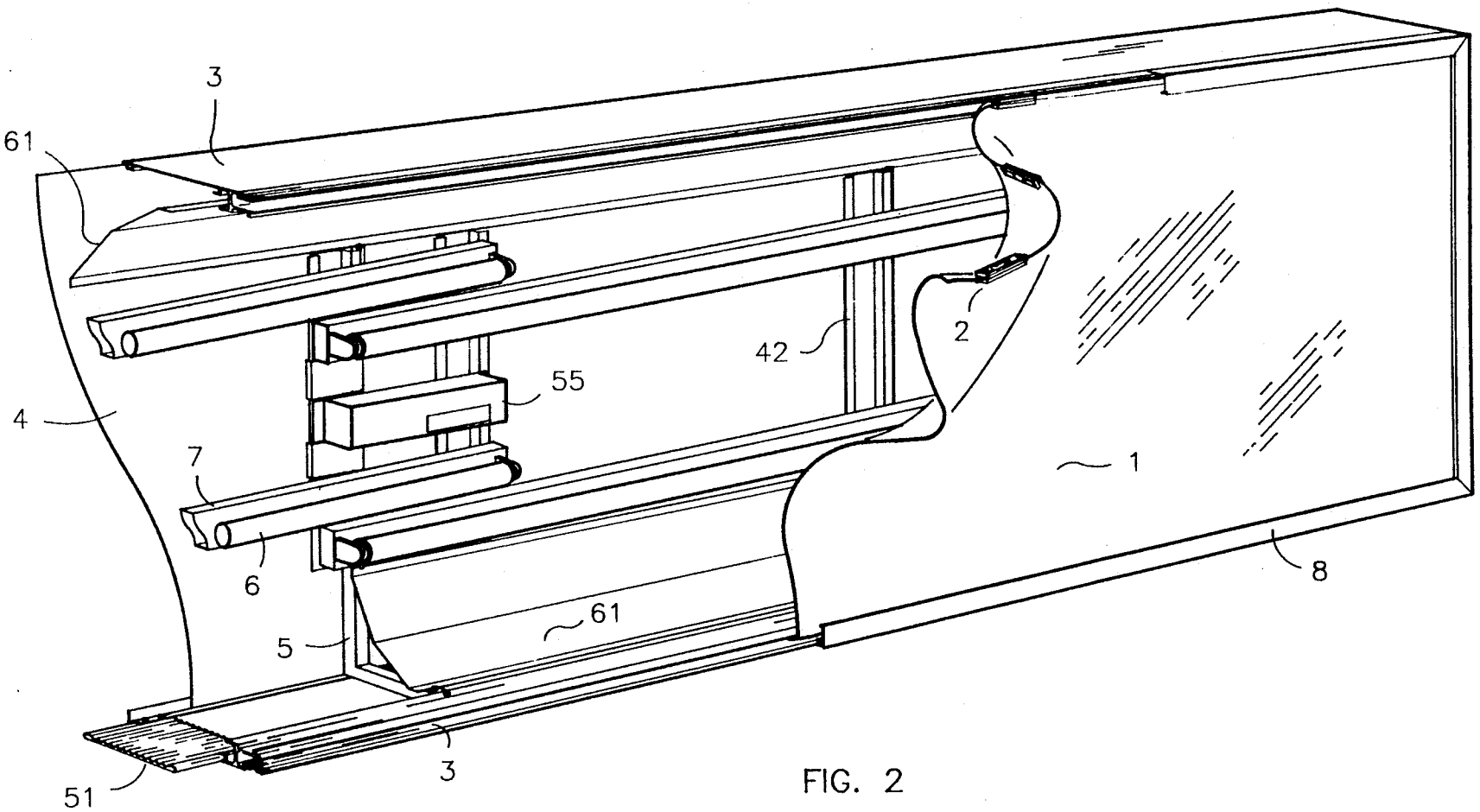
Figure 3:
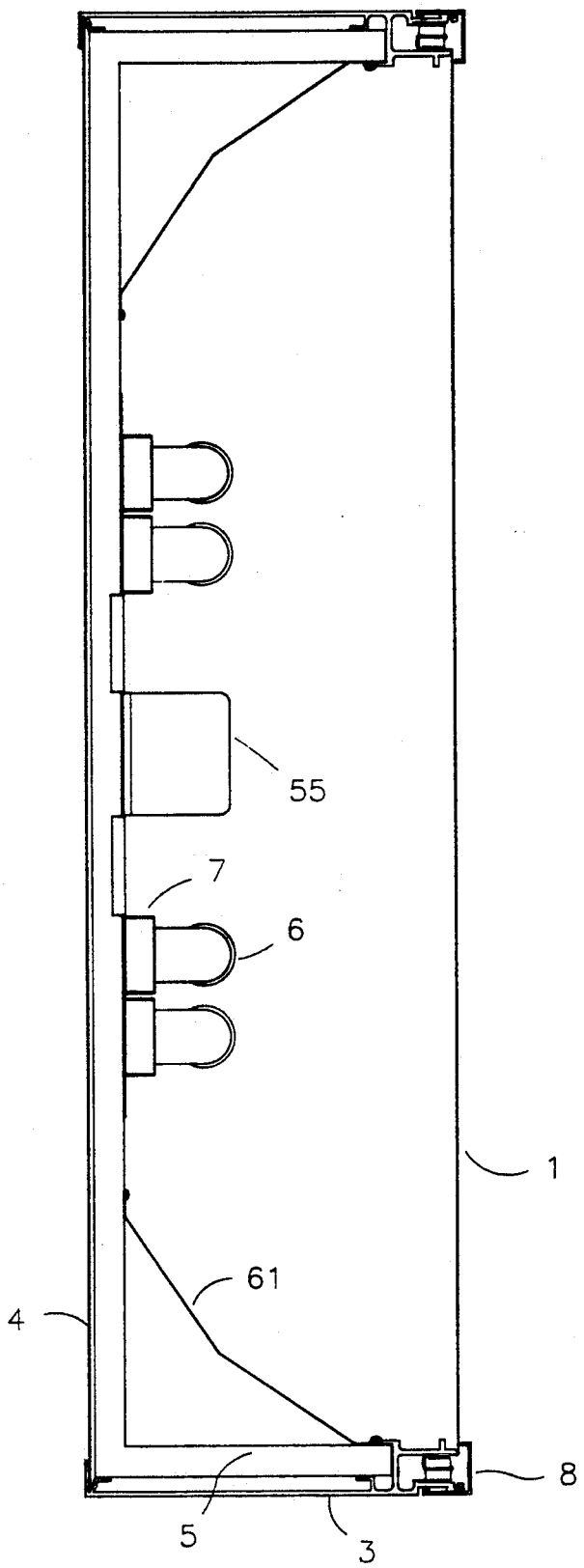
Figure 4:
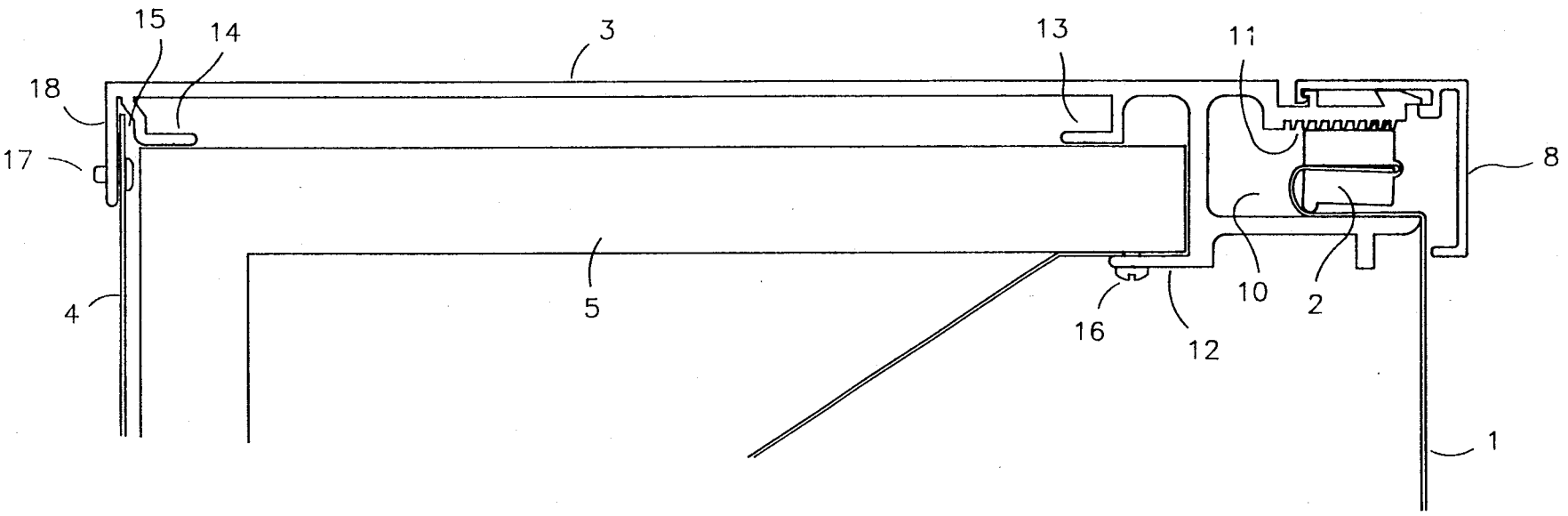
Figure 5:
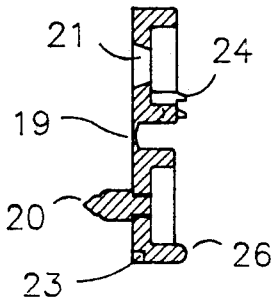
Figure 6:
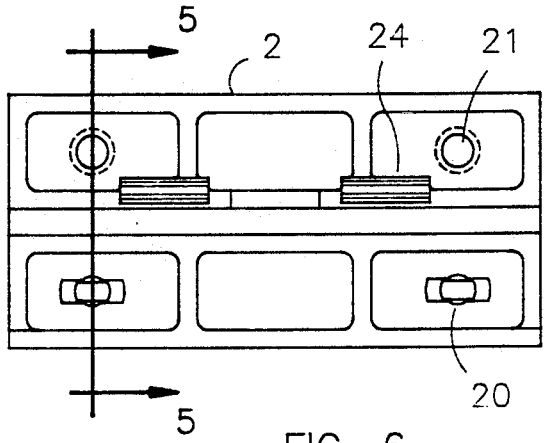
Figure 7:
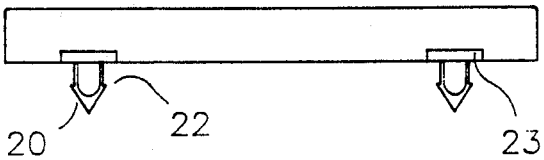
Figure 8:
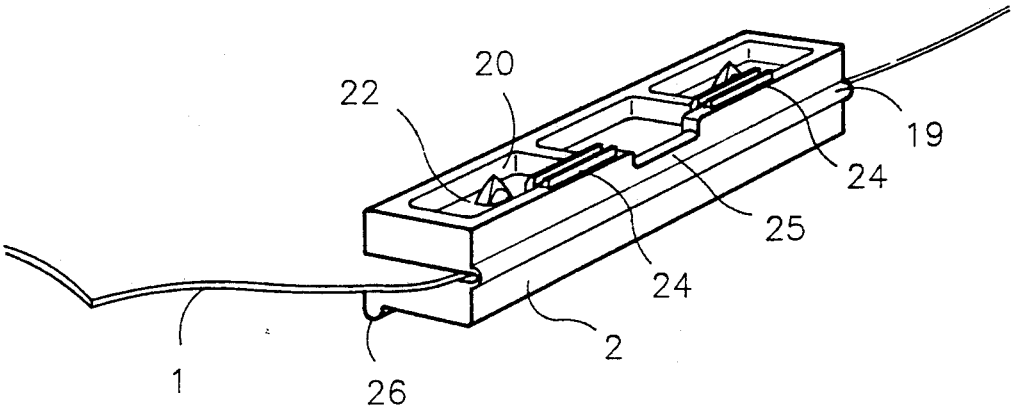
Figure 9:
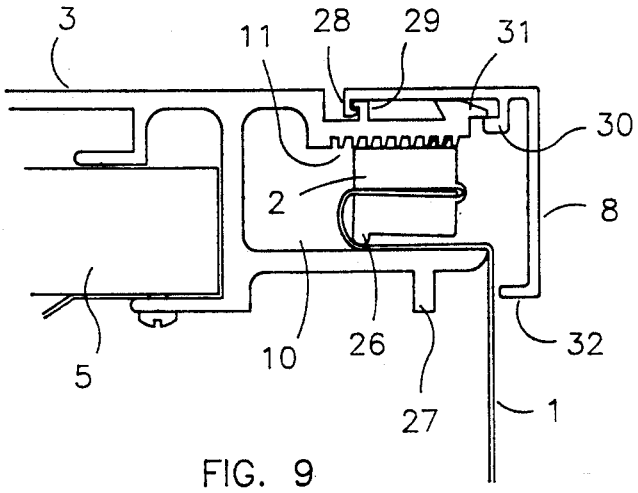
Figure 10:
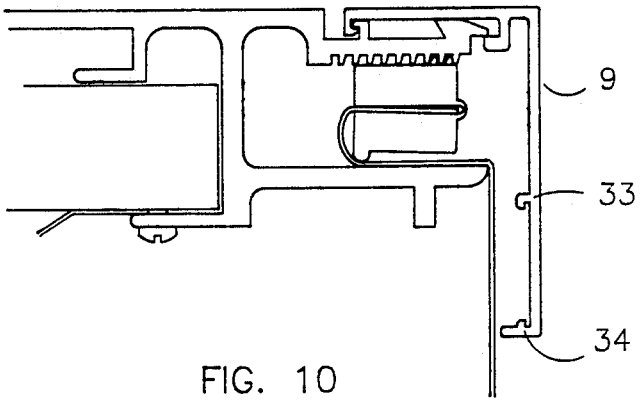
Figure 11:
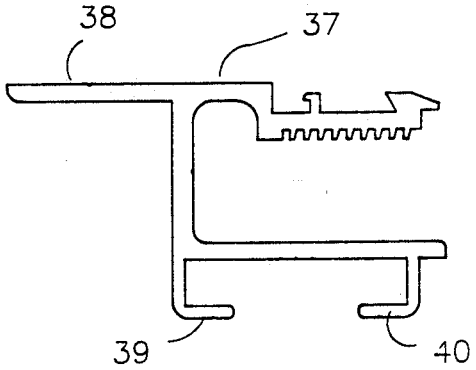
Figure 12:
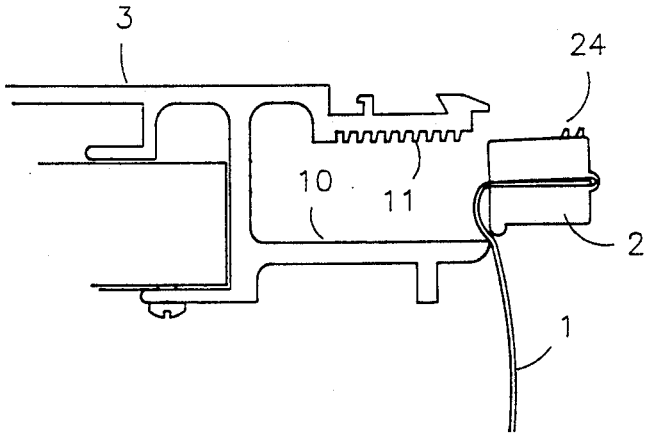
Figure 13:
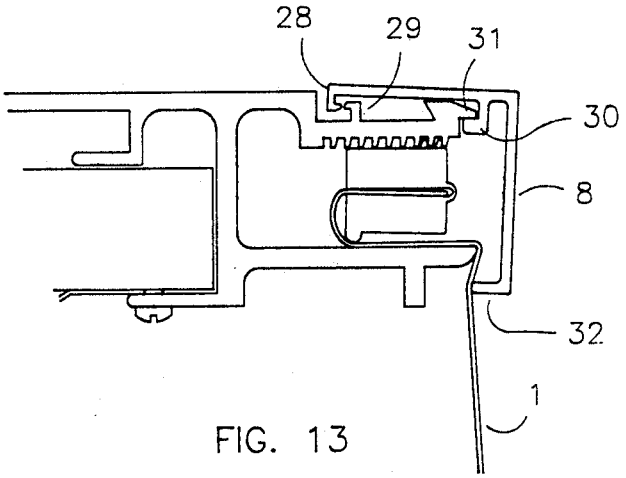
Figure 14:
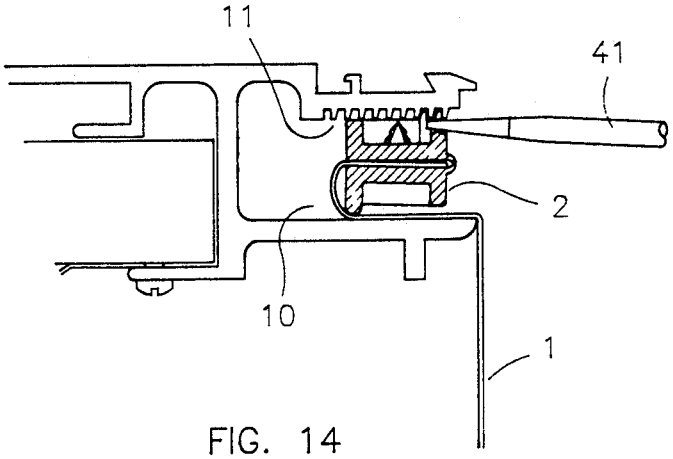
Figure 15:
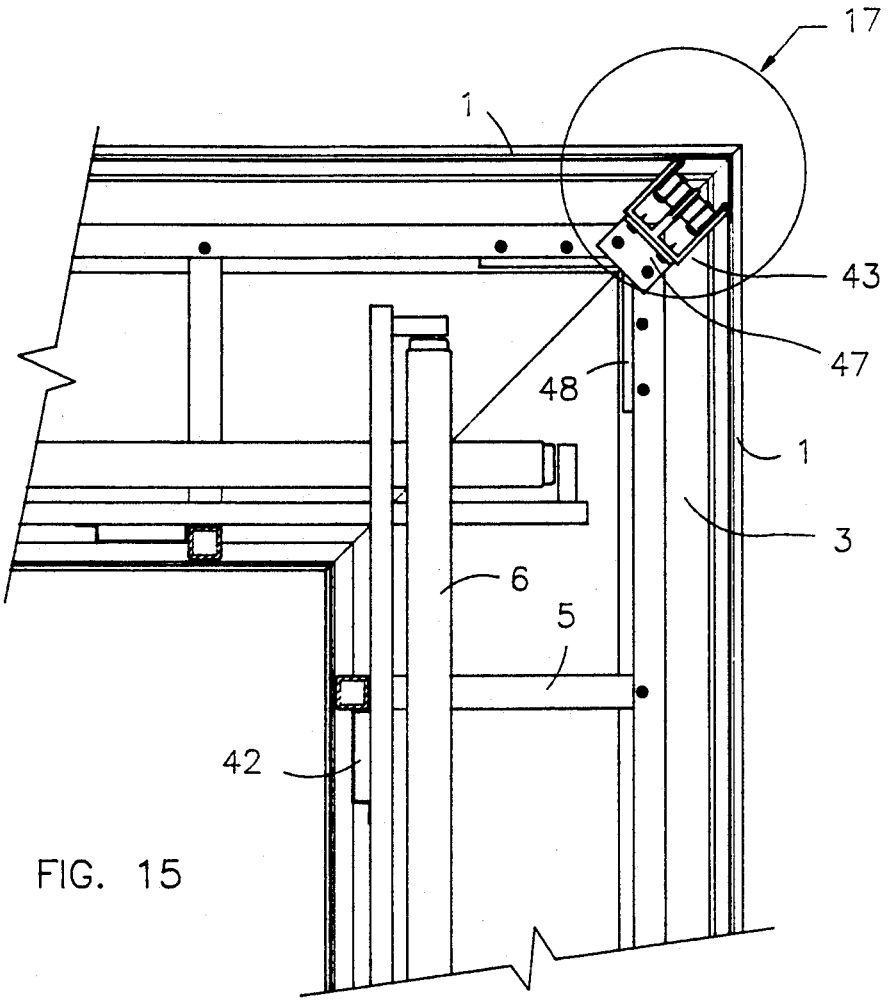
Figure 16:
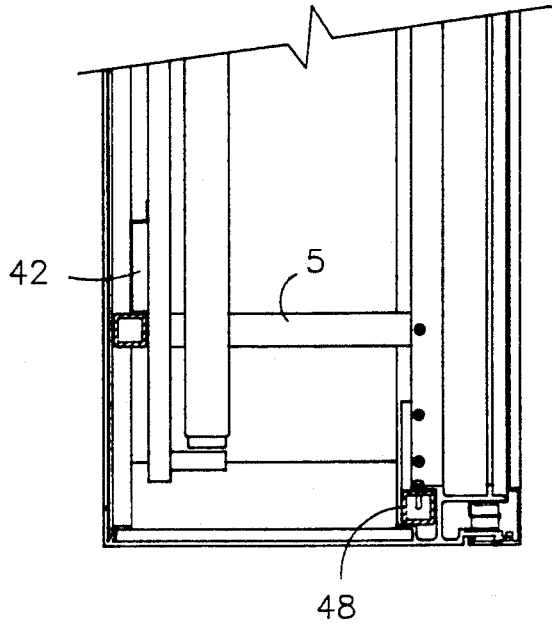
Figure 17:
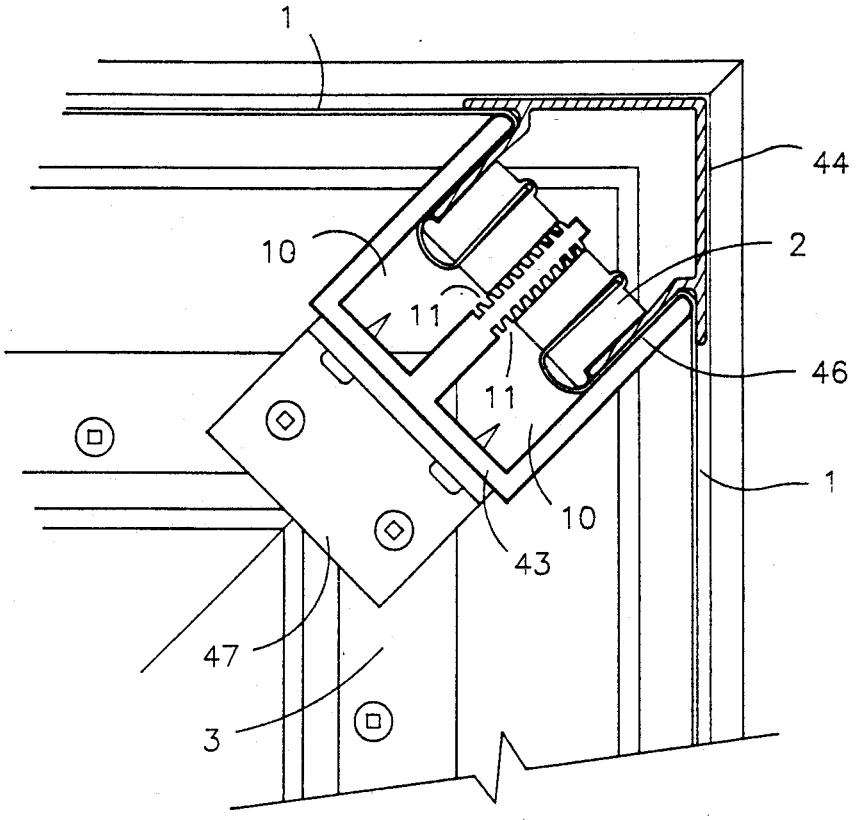

This invention relates to a FRAMING SYSTEM FOR SIGNS having a sheet of flexible sign material stretched across the opening of a frame.

It is a common practice with signs which have a flexible face material to use expanding rods installed at regular intervals along the length of the sign, to push the sides of the sign outwardly and thus stretch the flexible sign material. It is also another common practice to strengthen the sides of the sign with stiffeners, and to stretch the face material with adjustable clips installed on the edges of the flexible face material. In both cases, the expanding rods or stiffeners are installed inside the frame of the sign, between the flexible face material and the light fixtures illuminating the sign. Therefore, it is a common fact with these signs to see the rod's shadows through the face material.

It is also a common practice to stretch the flexible face material with adjustable clips installed at a precise distance from the edge of the flexible sign material. The installation of these clips requires the marking of lines, or the sewing of pockets, along the edges of the flexible sign material.

It is also a common practice to stretch the flexible sign material with adjustable clips which are retained to the edge of the sign framing with screws. These screws are used to locate the clips at a position which is more or less distant from a shoulder at the edge of the sign, and thus providing a mean of varying the tension of the face material.

Another common practice is to use adjustable clips having a series of serrations on one of its sides, which mates with an identical series of serrations on the edge of the sign. The adjustment of the tension of the flexible face material is done using special pliers to engage the clips onto few or several serrations.

It is a common fact with the adjustable clips described, that the installation of the face material, and the re-opening of sign for maintenance require special tooling, and precise dimensions for the flexible sign material.

Another common practice with these signs is that the periphery of the sign is made of two or more extruded sections, joined together with screws. It is further a common practice with the said signs to cover the exposed corner on the periphery of the sign with a cap. This corner cap is usually installed with screws. Such perforations in the casing offer the possibility for leakage of water or moisture inside the sign's casing. It is further a common fact with these sign, that the installation of the corner cap, and the re-opening of the sign for maintenance also require special tooling.

It is an object of the present invention to provide an improved illumination of the sign. This is done with a framing system which does not require expanding rods or stiffeners between the face material and the light source.

It is also an object of the present invention to provide a method of stretching the flexible face material using tensional devices which can be installed along the edge of the face material by hand. Moreover, the invention provides a method by which the face material does not require accurate dimensions, marking or sewing of pockets along its edges. The stretching of the flexible sign material is done by pushing the tensional devices into a slot along the opening of the sign's frame. The push of the devices is done by hand, with or without the use of a slot type blade screw-driver.

It is also an object of the present invention to provide a sign framing system having its sides made in one piece, and thus to prevent leakage of water or moisture inside the sign's casing.

It is also an object of the present invention to provide a sign framing system having a corner cap which is installed manually without fasteners. The cap is installed by engaging its rear portion into a retaining lip and by twisting it in its final position causing a set of mating lips to engage and retain it in place.

It is further an object of the present invention to provide a framing system which can be re-opened for maintenance with minimum tooling. The invention provides a framing system where the corner cap is removed by twisting it manually inwardly along its length. The invention provides a framing system where the tensional devices are removed by prying with a slot type blade screw-driver to disengage its embossments from the frame's serrations.

According to the present invention, the framing system comprises a rigid extrusion covering the periphery of the sign, and a sheet of metal covering the rear opening of the frame. A series of C-frames are attached to the sign support structure with screws through the backing skin of the sign. The C-frames are attached at regular spacings inside the sign casing, to the side extrusions using screws driven from the inside of the sign casing. The C-frames provide the rigidity and the accuracy of location for the side extrusions.

Each side extrusion has a slot at its edge along the front opening of the sign. The slot has a series of serrations on one of its inside face to engage with embossments on the tensional devices. The serrations provide adjustment in the location of the tensional devices and thus provide adjustment in the tension of the flexible face material.

The tensional devices are closed on the edge of a pre-cut flexible sign material by hand. The closing of the devices pushes two prongs protruding from one of its side through the flexible sign material and through two mating holes on its other side.

If ever the adjustment of the tensional devices reaches its limit due to the aging of the flexible face material, or for other reasons, the tensional devices can be re-positioned. This is done by trimming off with scissors a portion at the edge of the flexible face material, and by relocating the tensional devices.

The framing system described can be built on the job site using modular components. It can also be delivered as pre-fabricated sections and hoisted in place.

The flexible face material used for this invention is pre-painted, and delivered to the installation site in a rolled-up form. The roll of flexible face material is unwounded on a reel which rolls along the sign frame, supported by trolley wheels rolling on the upper extrusion.

Embodiments of the invention will now be described by way of example, with reference to the accompanying drawings, in which:

FIG. no. 1 is a general arrangement of a large rectangular sign, covering two faces of a corner.

FIG. no. 2 is an elevation of the framing system showing the principal components of the sign.

FIG. no. 3 is a sectional view along the line 3—3 of the FIG. no. 1.

FIG. no. 4 is a sectional view of the metal extrusion at the periphery of the sign.

FIG. no. 5 is a sectional view along the line 5—5 of the FIG. no. 6. The figure shows a cross-section of the tensional device.

FIG. no. 6 is a plan view of the tensional device.

FIG. no. 7 is an elevation view of the tensional device.

FIG. no. 8 is a perspective view of the tensional device.

FIG. no. 9 is a sectional view of the serrated slot, the tensional device and the small size corner cap.

FIG. no. 10 is a variation of the FIG. no. 9 showing a large size cap.

FIG. no. 11 is a sectional view of an extrusion which is used to refit existing signs with the present invention.

FIG. no. 12 is a sectional view of the serrated slot to explain the installation of the tensional device.

FIG. no. 13 is a sectional view of the extrusion to explain the installation and removal of the corner cap.

FIG. no. 14 is a sectional view of the extrusion to explain the removal of the tensional devices.

FIG. no. 15 is a plan view of the sign structure to explain the framing of corners.

FIG. no. 16 is a plan view of the sign structure to explain the framing of ends.

FIG. no. 17 is an enlarged view of the framing of corners.

FIG. no. 18 is a plan view of the sign structure to explain the framing of vertical joints in the flexible sign material.

FIG. no. 19 is a sectional view of a cap to cover a vertical corner in the sign framing.

FIG. no. 20 is a sectional view of a cap to cover a vertical joint in the flexible sign material.

FIG. no. 21 is a perspective view of the joining details for the corner cap.

FIG. no. 22 is a perspective view of the horizontal joining details for the side extrusions.

FIG. no. 23 is a perspective view of the joining details for the side extrusions at the ends of the sign.

FIG. no. 24 is a perspective view of an alternate method for joining the side extrusions.

FIG. no. 25 is a perspective view of an alternate method for joining the side extrusions at the ends of the sign.

FIG. no. 26 is a plan view of the lamp fixtures and of the wiring troughs.

FIG. no. 27 is an elevation view of the lamp fixture module showing the ballast and the wiring troughs.

FIG. no. 28 is an elevation view of the overlapping of two light fixture modules.

FIG. no. 29 is an elevation view for an alternate method for the overlapping of two light fixture modules.

FIG. no. 30 is a sectional view along line no. 30 on the FIG. no. 29. It shows the arrangement for the cap covering the wiring.

FIG. no. 31 is a sectional view along line no. 31 on the FIG. no. 28. It shows the arrangement for the wiring underneath the ballast.

FIG. no. 32 shows the light reflection pattern along the edges of the sign.

FIG. no. 33 is a sectional view of the reel to unwind the roll of flexible sign material.

FIG. no. 34 is an enlargement of the detail no. 34 on the FIG. no. 33. It explains the details of the trolley wheels rolling on the top extrusions.

FIG. no. 35 is the elevation view of the linkage holding the trolley wheel and the lower guide wheel at the proper distance from one another.

The new framing system illustrated on FIG. nos. 1, no. 2, and no. 3 comprises a flexible face material 1 which is supported by tensional devices 2. The tensional devices are adjusted into a metal extrusions 3 around the periphery of the sign. The framing system also comprises a backing sheet of metal 4 and a series of C-frames 5 spaced equally and bolted to the sign support structure using fasters driven from the inside of the casing, and through the backing sheet 4.

The sign is illuminated by light fixture 6 mounted in tandem and overlapping at each end. The light is reflected toward the edges of the sign on reflectors 61 installed at the top and bottom of the sign. The tensional devices 2 and the edge of the extrusion is covered by a corner cap 8.

Referring to FIG. no. 4, the extrusion 3 is positioned on the C-frame 5 using locating lips 12, 13 and 14. The extrusion 3 is retained to the C-frame 5 with a screw 16 driven from the inside of the casing through lip 12. The lip 14 forms a cavity 15 to mate with the edge of the backing sheet 4. The extrusion 3 is attached to the backing sheet 4 using screws 17 or rivets through lip 18 of the extrusion. The extrusion 3 is made in one piece to prevent leakage of water or moisture inside the sign's casing.

The extrusion 3 has a slot 10 at the edge facing the front of the sign. The outside wall of this slot 10 has a series of serrations 11 to mate with embossments on the tensional device 2.

Referring to FIG. nos. 5, 6, 7 and 8, the tensional device 2 is made of two halves with a thin section 19 along the centre line of its long axis. One half has two prongs 20 protruding from its surface. The other half has two tapered holes 21 to mate with the prongs 20 when the device is bent fully along the thin section 19. Each prong 20 has a pointed end and a recess in its diameter below the point. This recess forms a sharp edge 22 which is slightly wider than the small diameter of the taper hole 21.

The tensional device 2 is installed on the flexible face material 1 by bending the device 2 manually along its thin edge 19, over the edge of the face material. The two prongs 20 will puncture through the face material 1. The sharp edge 22 locks through the taper holes 21 to keep the device 2 closed over the face material.

The tensional device has two shallow slots 23 on its edge near the prongs. The provision for the slots 23 is to pry the device open with a slot type blade screw-driver, for re-positioning it to a new location.

The tensional device 2 has two sets of sharp embossments 24 to engage in the serrations 11 of the extrusion 3. The tensional device 2 has a recess 25 between the embossments 24. This recess is used to pry the devices out of the serrations 11 using a slot type blade screwdriver.

The tensional device has another embossment 26 over its entire length. This embossment acts as a pivot point when the tensional device is pushed over the serrations 11 inside the slot 10, as it can be seen of the FIG. no. 9. The embossment 26 gives leverage to the tensional device 2 and forces it to rotate and to apply more pressure toward the serrations 11 when a tension is applied on the flexible face material.

The rib 27 on the extrusion 3 adds stiffness to the inside wall of the slot 10. The rib prevents excessive sagging between the supports 5, under the load applied by the flexible face material.

The cap 8 is installed on the extrusion 3 by clipping it in place. The lip 28 on the cap is engaged with the lip 29 of the extrusion. The cap is pivoted towards the front of the sign until the lip 30 on the cap slides over and clips on lip 31 on the extrusion. The cap 8 is prevented to disengage from the locked position by lip 32 which comes in contact with the flexible material, before the lip 28 releases from lip 29.

The removal of the cap 8 for maintenance purposes is done by forcing this lip 32 against the flexible face material 1 as it can be seen on the FIG. no. 13. The lips 30 and 31 can slide into one another until lip 28 disengaged from lip 29. The removal of the cap 8 is done manually by twisting it towards the inside of the sign's frame.

A wider cap 9 can also be used. In this case, the joining of two sections of caps is done with a piece of flat metal 36 caps which fits precisely between lips 32 and 34 inside the face of the caps. This is illustrated on FIG. no. 10, and FIG. no. 21.

A conventional sign may be refitted with the new framing system using the extrusion no. 37. The installation of this extrusion over an existing sign is done with screws through the tongue 38, and into the existing frame. The reinforcement of this extrusion at the joints is done with a flat piece of metal between grooves 39 and 40, which overlaps the two sections.

Referring to FIG. no. 12, the illustration explains the turning of the tensional block 2 over the flexible material 1 before it is pushed inside the slot 10 of the extrusion 3.

The tensional block 2 can be removed from the slot 10 by prying with a slot type screw-driver blade 41 between the serrations 11 and the devices 2, to force the embossments 24 out of the serrations 11. The removal of the device is completed by pushing in the flexible face material 1 to increase its tension and pull the device out of the slot 10, as it can be seen on FIG. no. 14.

Figure 18:
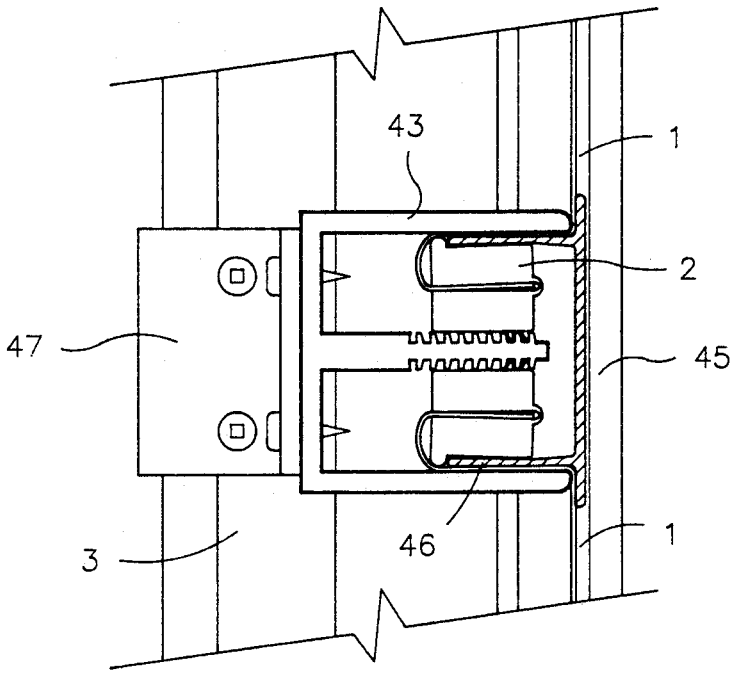
Figure 19:
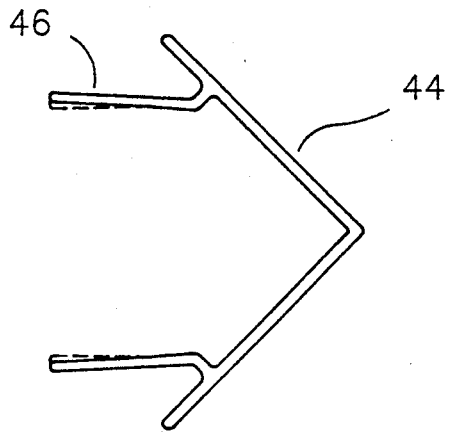
Figure 20:
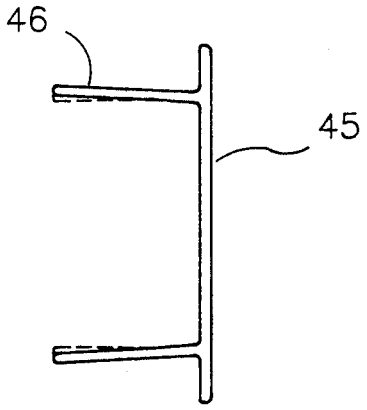
Figure 21:
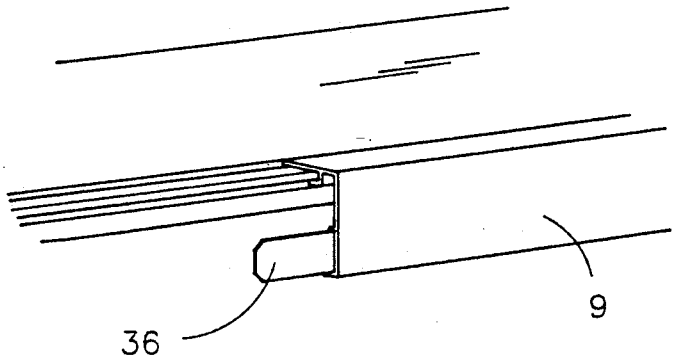
Figure 22:
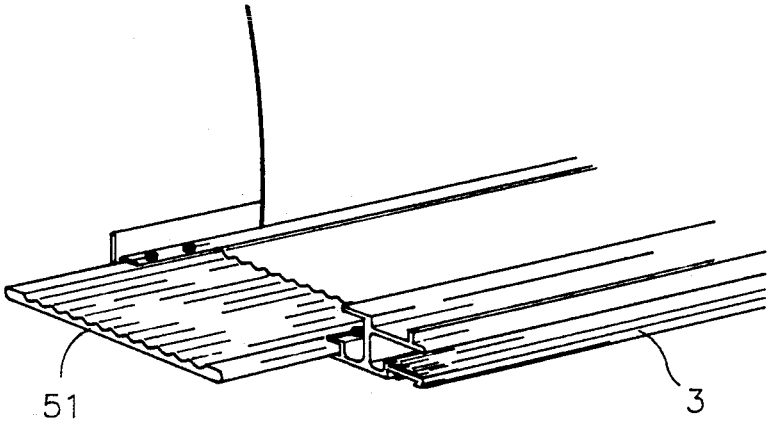
Figure 23:
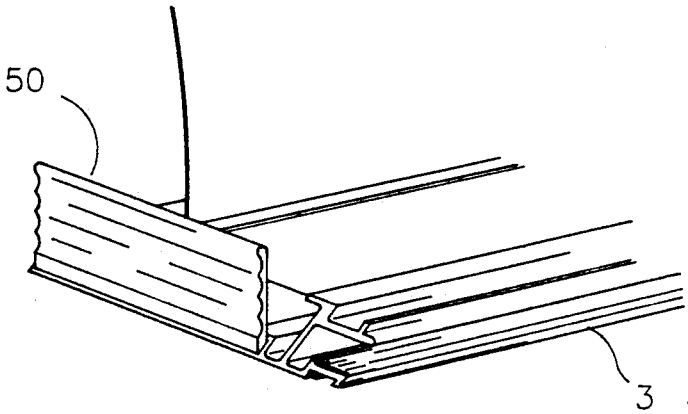
Figure 24:
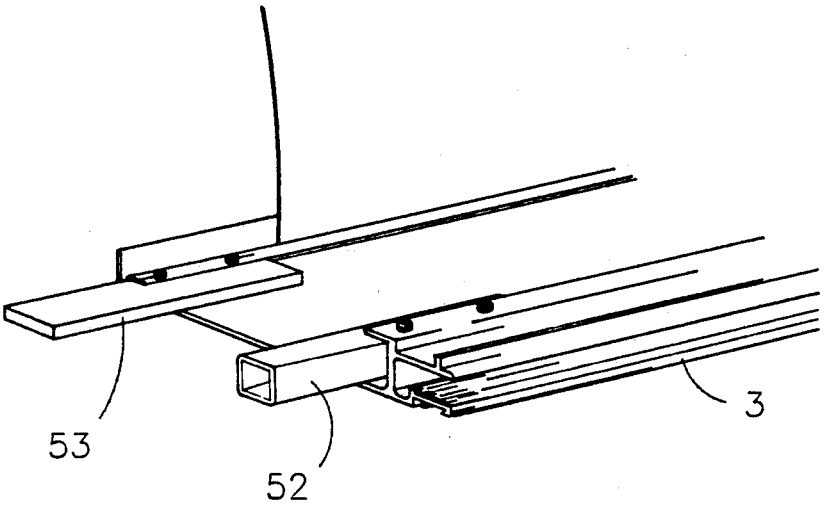
Figure 25:
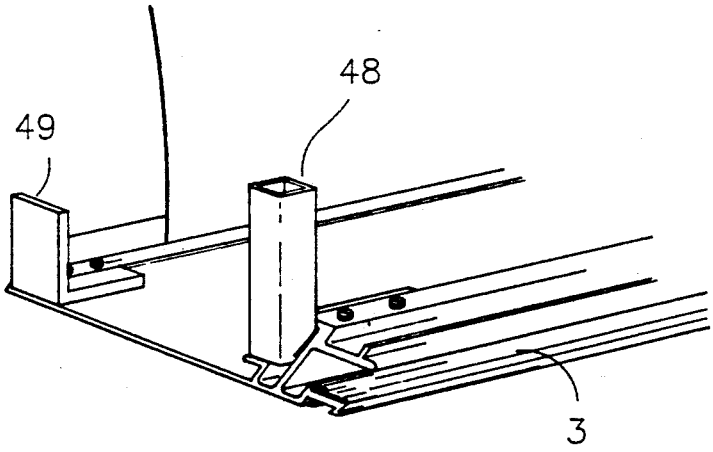
Figure 29:
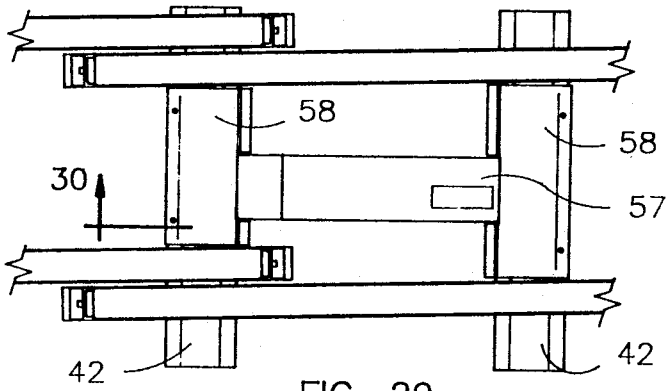
Figure 28:
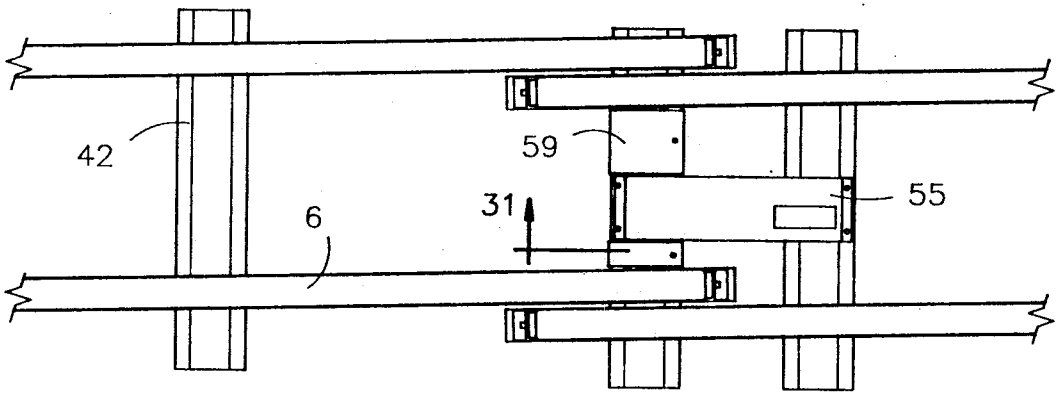
Figure 26:
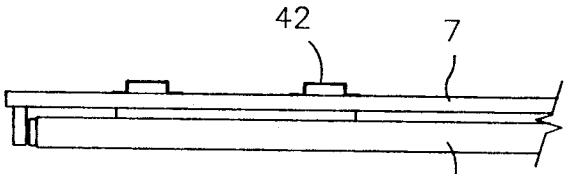
Figure 27:
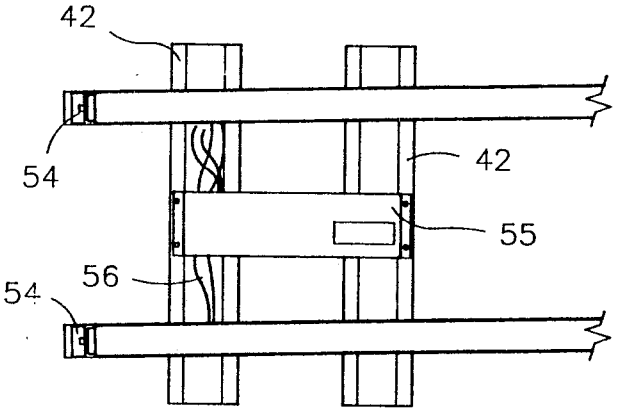
Figure 30:
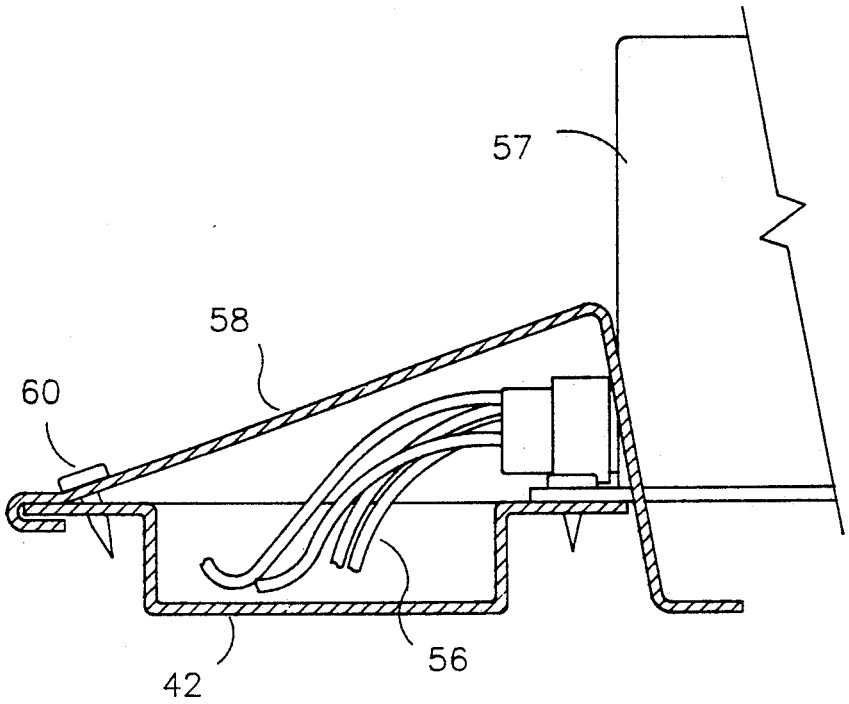
Figure 31:
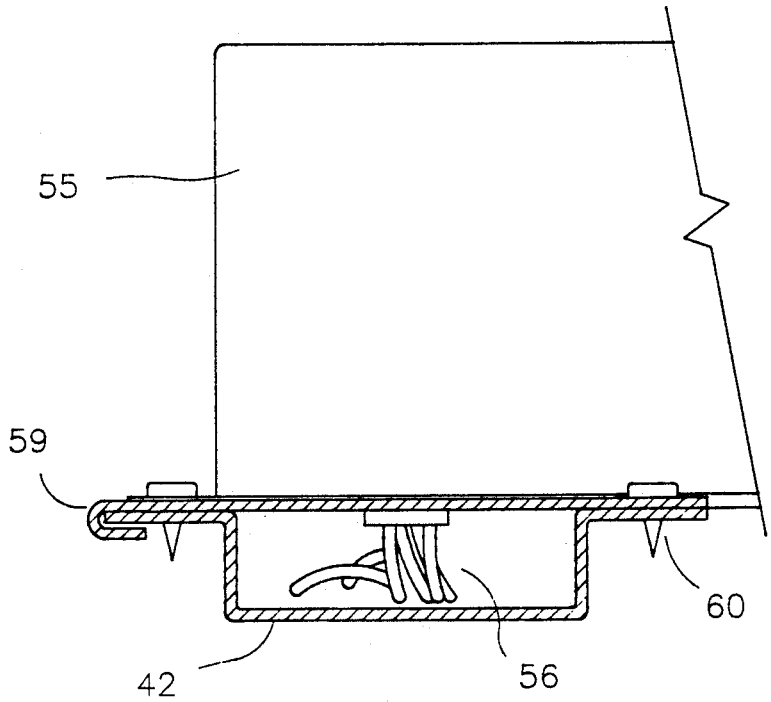
Figure 32:
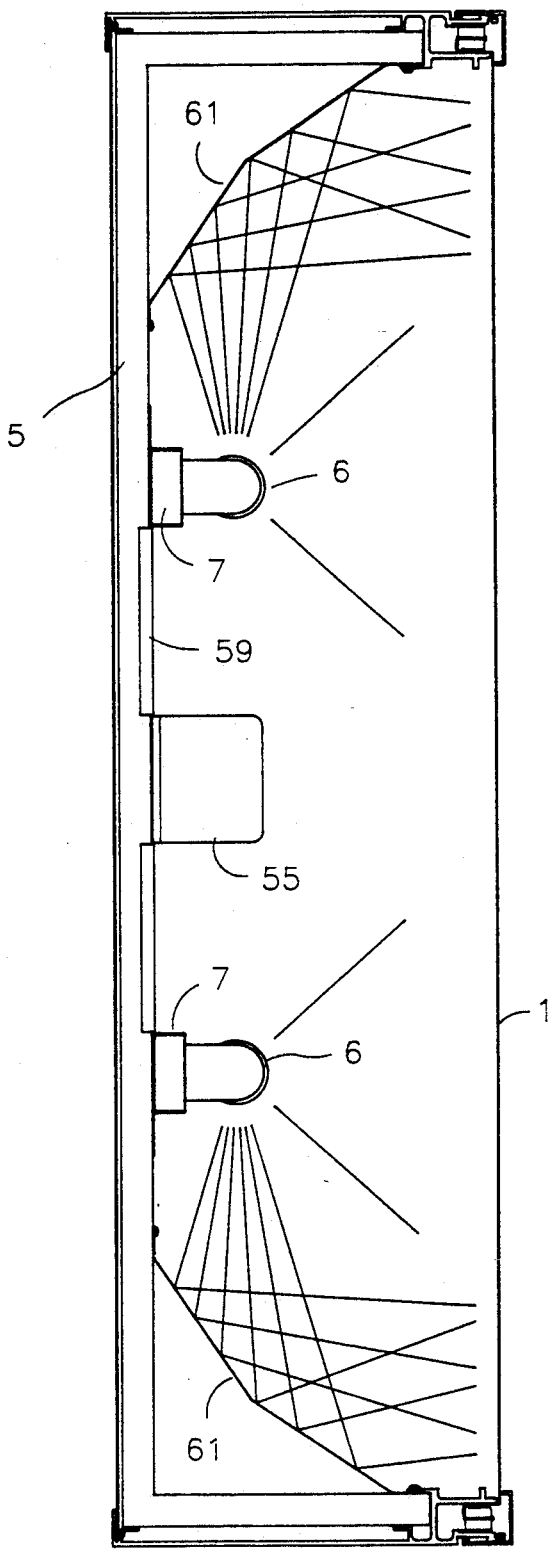
Figure 33:
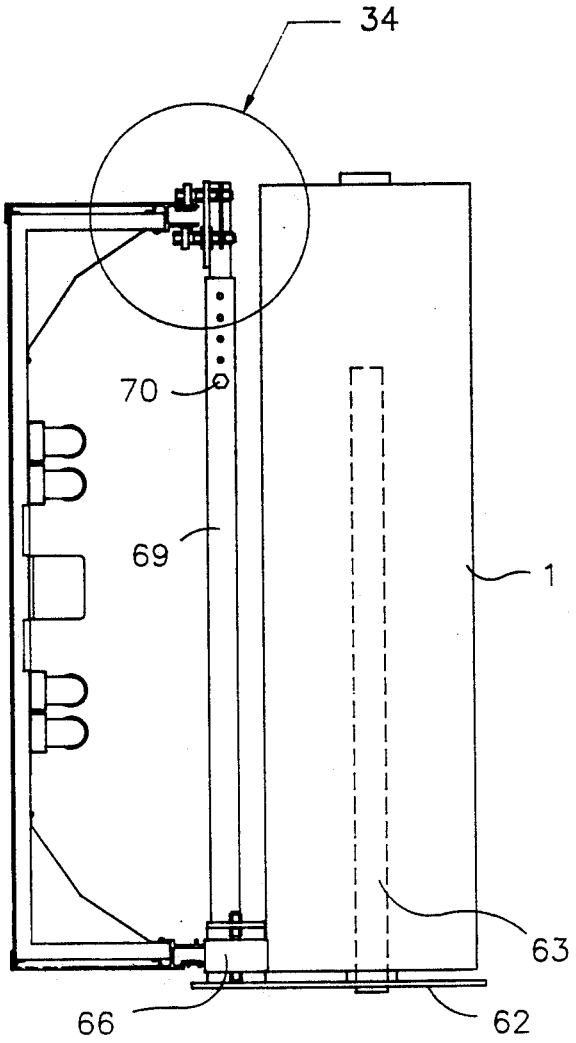
Figure 34:
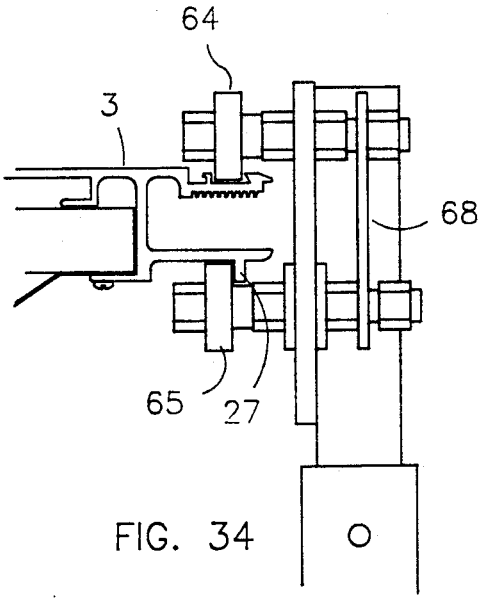
Figure 35:
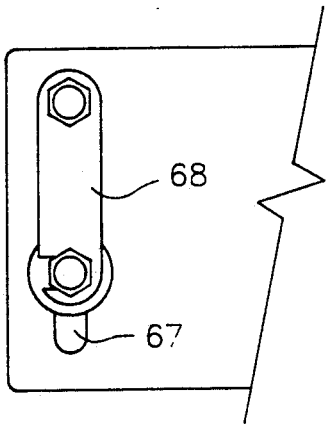

The FIG. no. 15 illustrates the overlapping of the light tubes 6 at corners and it illustrates the location of the wiring trays 42. The FIG. no. 15 illustrates also the components used to stretch the face material 1 longitudinally at corners. The flexible face material 1 is cut at corners. A special extrusion 43 having two slots 10 side by side and two series of serrations 11 is used to retain two series of tensional devices 2, each set holding to one edge of the flexible face material. An enlarged view of this is shown on FIG. no. 17. The same extrusion 43 is used to make joints in the flexible face material 1 as shown on FIG. 18.

The extrusion 43 is attached to the framing extrusion 3 with clip angles 47 and screws, at each of its extremities.

The slots 10 and the tensional devices 2 in the extrusion 43 are covered with a corner cap 44 at corners and with a flat cap 45 at joints. Both caps have legs 46 which can flex to fit between the extrusion 43 and the tensional device 2. The deflection of the legs 46 causes the legs to apply an outward pressure against the opening of the slot 10. This pressure together with the squeezing force of the tensional device over the leg 46 keep the cap in place.

Several methods of joining the extrusions 3 at corners is illustrated on FIG. nos. 15, 16, 22, 23, 24, and 25. A variety of combinations of stiffeners can be used. Vertical corners can be joined using corner tubing 48, clip angles 49 and full width angles 50. Horizontal corners and horizontal joints can be made with joining plates 51, straight tubing 52, and flat bar 53. In all cases these stiffeners are attached to the extrusions 3 and 43 using screws.

The light fixture casings 7 can be used as a single string of lamp tubes in a narrow sign. The light fixture casings 7 can be grouped two or more together with connection trays 42, to accommodate for wider signs. The light sockets 54 are wired with electrical conductors 56 passing through the fixture casing 7 to the ballast 55. The wiring connections for the electrical supply to a light fixture module, or in between adjoining light fixture modules, are done in a connection tray 42. The tray 42 is normally covered by the adjoining light fixture module. Otherwise, and in cases where the width of the fixture casing 7 is not sufficient to cover the tray 42, sheet metal covers are used to cover the tray entirely.

The FIG. no. 30 illustrates a sheet metal cover 58, which is used with a ballast 57 having its wiring 56 coming out from the end. The FIG. no. 31 illustrates a sheet metal cover 59 which is used with a ballast 55 having its wiring 56 coming out from the bottom. Both types of covers 58 and 59 are attached to the connections trays 42 with screws 60.

The light tubes 6 and light fixtures 7 are installed on the frame members 5 near the centre line of the sign. The reflectors 61 send an even distribution of light to the outer edges of the sign. The reflectors 61 are installed on the frame member 5 with screws.

The FIG. nos. 33, 34 and 35 illustrate one of many possible methods to install the flexible face material 1. The flexible face material is delivered to the installation site in a rolled up form. A reel plate 62 and reel axle 63 are used to unwind the roll of flexible sign material 1. The reel assembly is supported by trolley wheels 64 which roll on the top extrusion 3. The weight of the reel assembly is counter balanced with a set of horizontal wheels 66 rolling against the nosing of the lower extrusions 3. Additional trolley wheels 65 lock the reel assembly in place. These wheels 65 are free to slide up and down in slots 67. These are held in the upper position, against the lower face of extrusion 3 and behind lip 27, by the latch blade 68. The latch blade 68 pivots on the axle of the trolley wheel no. 64. The latch blades 68 are used to secure the reel in place on the sign frame or to remove it after completion of the face material installation.

The reel assembly is adjustable to different height of signs. Its central support member 69 is made of two hollow sections sliding into one another. A bolt 70 through a combination of holes in the support member 69 is used to adjust the height of the reel assembly.

The embodiments of the invention in which an exclusive property or privilege is claimed, are defined as follows.

1. A framing system for signs comprising in combination;

a generally rectangular casing having two end members, and top and bottom members, joining one another at corners, said casing members defining a front plane, a rear plane, an inner zone, and an outer zone, a slot along the said casing members, said slot facing forwardly and having a wall near the said outer zone, said wall having an inner surface covered partly by serrations, said serrations being parallel with the axis longitudinal of said members, a face material stretched across the said front plane by means of tensional devices installed on a border of the said face material, said border being folded half a turn over each tensional device, said tensional device having embossments to engage into the said serrations inside the said slot, said embossments being slightly inclined rearwardly, providing engagement means to snappingly engage with successive serrations thereby stretching the said face material, said fold, in reaction to tension in the said face material, applying a torsional moment on the said tensional devices and thus securing the said embossments from slipping from their positions on the said serrated wall, a skeletal structure comprising; the said top and bottom members of the said casing, and a series of C-frames attached at regular intervals along the said top and bottom members, said C-frame comprising a vertical stem located in the said rear plane, and two arms pointing towards the front plane, one at each extremity of the stem, said one being adjacent to the top member and said other one being adjacent to the bottom member, wherein said skeletal structure provides the means of strengthening said casing against the tension of the face material, without intersecting the inner zone of the said casing.

2. A device for use in association with a slotted frame member along a periphery of a sign, said device providing the means for anchoring a border of a face material, and for stretching said face material across the opening of a sign, said tensional device comprising;

a folding body having dimensions appropriate for holding in one person's hand, a thin section along the centre line of said body, providing a hinge, two pointed prongs, protruding from one half of the said body, two holes on the other half of the said body, said holes being positioned to align with the said prongs when the said body is folded, said folding motion providing the means of puncturing said face material with said prongs, each said prong having a recess in its diameter so that an edge of that recess locks through a respective mating hole when said body is completely folded, thereby keeping the tensional device closed on the face material, the distance of said punctured holes from the edge of said face material being equal to the distance between said prongs and said thin section, said distance leaving sufficient material to resist stretching of the said face material.

3. A longitudinal cap for encasing the contour of a face of a sign, said cap being used in associated with framing members along a periphery of the said sign, said framing members defining an inner zone, an outer zone, a front plane and a rear plane, each said framing member having an inner surface, an outer surface, a front edge and a rear edge, said outer surface having two outer lips near said front edge, said outer lips extending towards said outer zone, each, respective outer lip having a projection which extends in a direction away from one another when viewed at right angle to the longitudinal axes of said framing member, said cap having a L-shaped cross-section, said cross section having a leg parallel to said front plane, and another leg parallel to said outer surface of said framing member, said other leg having two inner lips extending towards said inner zone each respective inner lip having a projection which extends in a direction towards one another when viewed at right angle to the axis longitudinal of said cap, the distance between the projections of said inner lips being slightly smaller than the distance between the projections of said outer lips, such that the projections of the inner lips interfere with the projections of the outer lips, the interference of the projections thereof provides the engagement means for clipping and retaining said cap in place on said framing member.

* * * * *